US006517214B1

(12) United States Patent
Mitchell, Jr. et al.

(10) Patent No.: US 6,517,214 B1
(45) Date of Patent: Feb. 11, 2003

(54) LIGHTED SAFETY HUNTING AND OUTDOOR ACTIVITY VEST

(76) Inventors: Kenneth C. Mitchell, Jr., R.R. 1, Box 384AA, Ripley, WV (US) 24271; David Urbanus, 38 Galahad Way, North Easton, MA (US) 02356

( * ) Notice: Subject to any disclaimer, the term of this patent is extended or adjusted under 35 U.S.C. 154(b) by 0 days.

(21) Appl. No.: 09/448,723

(22) Filed: Nov. 24, 1999

(51) Int. Cl.[7] ..... F21V 21/08

(52) U.S. Cl. ..... 362/108; 362/103; 362/240; 362/800; 2/94

(58) Field of Search ..... 2/94, 102; 362/103, 362/108, 240, 800, 223

(56) References Cited

U.S. PATENT DOCUMENTS 4,328,533 A * 5/1982 Paredes ..... 362/108
4,709,307 A * 11/1987 Branom ..... 362/103
5,535,106 A * 7/1996 Tangen ..... 362/108
6,267,482 B1 * 7/2001 Miller et al. ..... 362/103

* cited by examiner

*Primary Examiner*—Stephen Husar
(74) *Attorney, Agent, or Firm*—Charles G. Call

(57) ABSTRACT

The method of enhancing the safety of individuals who perform activities which are made more hazardous when poorly illuminated, such as hunters who risk being shot by other hunters in the dark, and those who perform activities on or near vehicle roadways, such as joggers, construction workers, motorists is disabled vehicles, and bicyclists. These individuals are provided with an outer garment, preferably taking the form of a vest, which is fitted with a plurality of electrically operated lamps on both its front and rear panels. The lights are energized continuously or in an automatic flashing mode from a battery attached to and carried by the safety vest. Reflective strips or panels are preferably affixed to the exterior of the vest in adjacent to the lamps, thereby increasing the visibility of the individual when illuminated and enhancing the luminosity of the lamps. The vest may be advantageously constructed of a mesh material to permit cooling air to freely circulate.

6 Claims, 2 Drawing Sheets

LIGHTED SAFETY HUNTING AND OUTDOOR ACTIVITY VEST

FIELD OF THE INVENTION

This invention relates to methods and garments for protecting hunters, highway construction workers, and others engaged in outdoor activities who are subjected to hazards due to their poor visibility in poorly lighted conditions.

BACKGROUND OF THE INVENTION

Participants in hunting and outdoor activities are often subjected to increased risk due to their limited visibility under poor viewing conditions at dusk, during the night, or at dawn, or when visibility is poor due to inclement weather.

Safety vests and other wearable apparel or devices which include of fluorescent color panels and light reflective strips have proven to be somewhat effective, but have disadvantages. They require a separate and independent light source for illumination, and this secondary light source is often inadequate or completely unavailable.

Notably, in hunting activities most of the danger to the hunter exists when the hunter is walking through the woods in pre-dawn light when the bright fluorescent orange garments frequently worn by hunters are nearly useless.

Outdoor sporting activities such as running, walking, and bicycling, when performed in the evening or other poor light times are precarious for the participant when they utilize roadways for this activity. There exists the inherent danger to the participant from automobiles whose drivers cannot see them until the headlights of the automobile shine upon the participant. Current reflective garments are not sufficiently adequate because of the limited focal distance of the automobile light source.

Other work activities preformed outdoors such as road repair and construction crews and police details can be made safer to the participants because the bright flashing LED's can be more readily seen than just reflective vests or garments. Often the practice of road constriction sites utilizing large flashing yellow lights causes glare to the oncoming motorists whose visibly is temporarily diminished therefore limiting their ability for see the reflective garments worn by road crews or police.

Automobile breakdowns along highways are particularly dangerous when they occur under poorly lighted conditions. Flares and other accident warning lights are often unavailable to protect individuals changing a tire or attempting other repairs, and even if used don't clearly identify the presence of people who may move onto or near the roadway.

Bicyclists and joggers are frequently compelled to use roadways and are particularly in peril at night or under other conditions of poor visibility. For the reasons noted above, reflective clothing is frequently inadequate, as is the limited active lighting provided on the bicycle itself.

There is accordingly a significant need for improved methods and safety articles which can protect persons engaged in hazardous activities under poorly lighted conditions.

SUMMARY OF THE INVENTION

It is a general object of the invention to protect persons who are performing activities made more hazardous by poor lighting.

It is a related object of the invention to provide increase the safety of persons performing such activity by providing means for clearly indicating their presence and location.

It is a further related object of the invention to provide a safety vest which carries thereon a plurality of battery operated electric lamps visible from all directions which may be worn on the body to clearly signal the presence of the wearer to others.

It is a further object of the invention to protect hunters, workmen, motorists and others engaged in outdoor activities against injury which is more likely to occur if such persons cannot be easily seen due to darkness, inclement weather or other environmental conditions.

In a principle aspect, the present invention takes the form of a method for enhancing the safety of an individual engaged in a hazardous activity comprising the steps of providing a wearable over-garment, such a vest, which is fitted with a plurality of independent electric lamp light sources positioned on the exterior of the garment, and wearing the garment during the performance of the hazardous activity with the lamps illuminated such that the presence of the wearer is clearly indicated from all directions.

The principles of the invention may be applied to particular advantage to protect hunters, or other persons who must be present where hunting is taking place, from being shot when mistaken for prey in poorly lighted conditions. In accordance with the invention, each such hunter or other person is provided with a lighted safety vest of the type contemplated by the invention which is then worn, with the vest lights illuminated, when the person is in the hazardous, poorly lighted area.

The principles of the invention may similarly be used to advantage to protect highway workmen, stranded motorists, and others who are on or near roadways at night, during bad weather, or under other conditions in which the visibility of the person to motorists is poor.

It is a further object of the invention to provide a new lighted hunting and outdoor activity safety vest which is of a durable and reliable construction, and which has a low materials and labor cost of manufacture.

The lighted safety hunting and outdoor activity garment contemplated by the invention preferably takes the form of a vest constructed of either or mesh, a solid lightweight material, or a combination of both materials. The vest is preferably fastened in the front by a zipper, buttons, snaps, Velcro® straps, or other suitable fasteners. The lighted safety hunting and outdoor activity vest exposes a plurality of electric lamps distributed on the front, side and back of the vest and is provided with a power source in the form of a battery and a switch. The lights are permanently attached to and integrated into the structure of the vest.

The lights may advantageously take the form of light emitting diodes (LED) characterized by their small size, brightness, wide viewing angle and low battery consumption. At least four and up to eight individual lamps are preferably located on the front of the vest and a like number are located on the back of the vest. In addition, lights on both front and back of the vest are positioned so they can easily be seen from either side of the wearer. The lights may be white, include colored lenses, or may naturally emit monochromatic light of selected colors. The colors of the lights and/or lenses are preferably white, red, green, yellow or any combination of all of these colors. Red lights are preferrably be used for safety vests intended for hunting since deer and other prey animals are unable to easily see light in the red portion of the spectrum, just as they cannot see the fluorescent red and orange hunting garments which are used to identify hunters in the daytime.

Safety vests intended for use in a roadside environment by construction workers, police, motorists, etc. preferably incorporate automatic intermittently operating switch means which flash some or all of the lamps of the vest to improve their visibility and distinguish the lighted vest from construction and warning lights which may be placed near a roadway hazard.

Vests for use in both hunting and roadside environments also preferably incorporate visible reflective strips or panels, allowing the presence of the wearer to be clearly indicated in daylight conditions or when artificially illuminated. The reflective strips may advantageously positioned adjacent to the electric lamps so that the light from the lamps is additionally reflected off of the reflective material to enhance the visibility of the vest.

These and other objects, features and advantages of the invention may be more clearly understood by considering the following detailed description of specific embodiments of the invention. In the course of this description, frequent reference will be made to the attached drawings.

DETAILED DESCRIPTION

Figure 1:
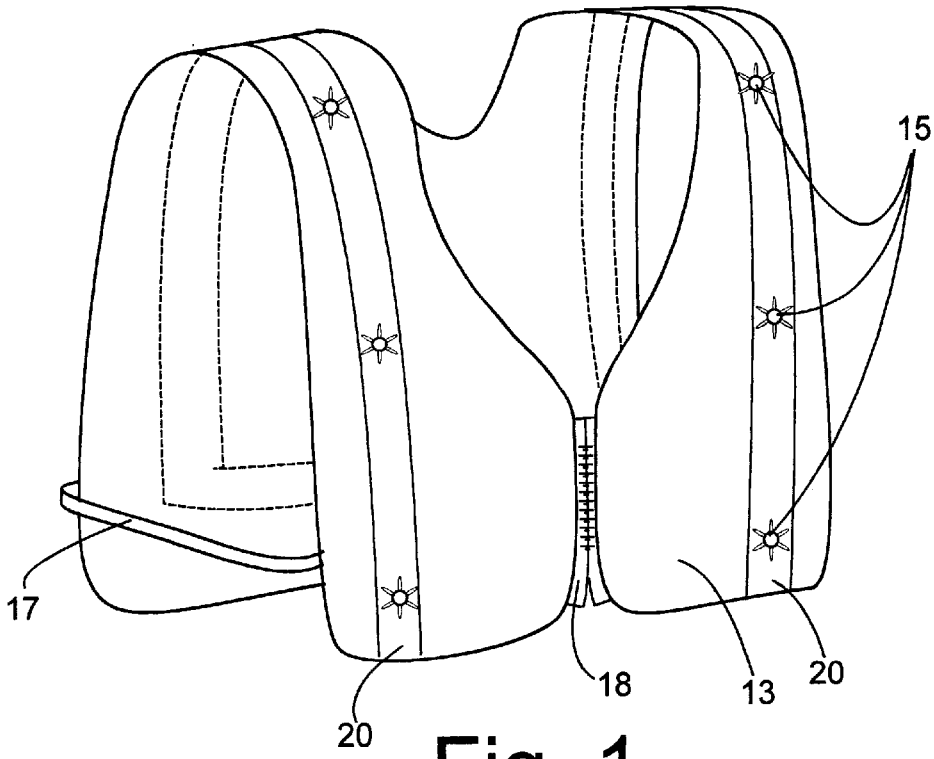
FIG. 1 is a perspective front view of a lighted safety vest which may be used to implement the present invention.
Figure 2:
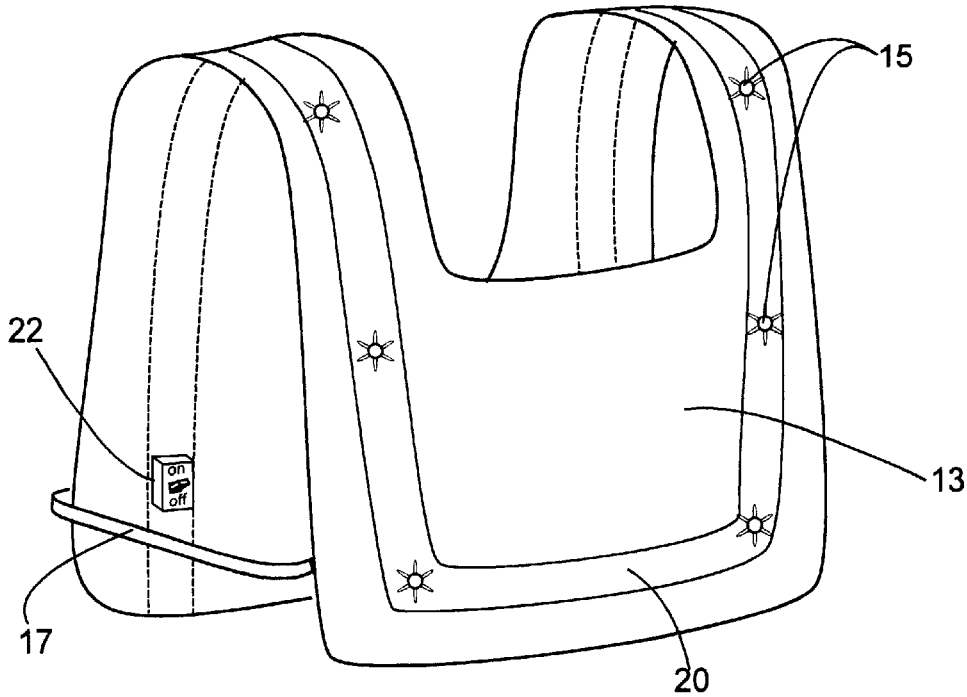
FIG. 2 is a perspective rear view of the lighted safety vest.

A lighted outdoor safety vest of the type contemplated by the present invention is illustrated in FIGS. 1 and 2 of the drawings.

The body of the vest 13 is preferably constructed of a lightweight material which can be worn over normal garments. If desired, the material may be heavy mesh of sufficient stiffness that the vest retains its general shape while still allowing cooling air to easily circulate through the vest. Mesh material is particularly desirable in a vest intended for use to protect roadside workers and motorists who will wear the vest in warm climates. A safety hunting vest, however, may be made of insulating material so that it can provide warmth as well as increased safety. The material, whether mesh or solid fabric, should be white or a bright color to increase its visibility.

A plurality of individual light emitting diodes seen at 15 are distributed over the exterior of the vest. As shown in the illustrative example of FIGS. 1 and 2, six lamps are positioned on the front and six lamps on the back of the vest. The lamps are positioned near the side edges of the vest so that some of the lamps are clearly visible from any direction. Side straps seen at 17 connect the front and back of the vest at the sides, passing under the wearers arms, keeping the vest in place on the body even in windy conditions and helping to insure the visibility of the lamps 15 from all directions. The lighted safety vest may be secured around a user in a with a zipper as illustrated at 18 in FIG. 1, or with snaps, Velcro(& straps, buckles or other suitable fastening device.

The lamps 15 are preferably positioned on top of a reflective strip 20 approximately 2" to 4" wide which extends vertically along each side of both the front and back of the vest. The reflective strip 20 improves the visibility of the vest under daylight and when the wearer is artificially lit. In addition, the electrical conductors which supply power to the lamps may be concealed and protected between the reflective strip 20 and the backing provided by the body 15 of the vest.

A power supply housing a battery for supplying electrical power to the lamps 15 is placed in a suitable housing provided with an exterior ON-OFF switch as seen at 22 in FIG. 2. The battery case 22 may include a conventional semiconductor or bimetal flasher control (not shown) which switches power ON and OFF intermittently at about 1 cycle per second or faster. The flasher circuitry, when incorporated into the system for roadside use, is preferably mounted within the battery case 22 and a three-position (Continuous ON, Flash, and OFF) switch. invention will be described. If desired, the battery case 22 may be placed within a fabric pocket or secured to the vest by a fastening device such that the battery case may be easily detached from the vest to facilitate cleaning or for storage.

Figure 4:
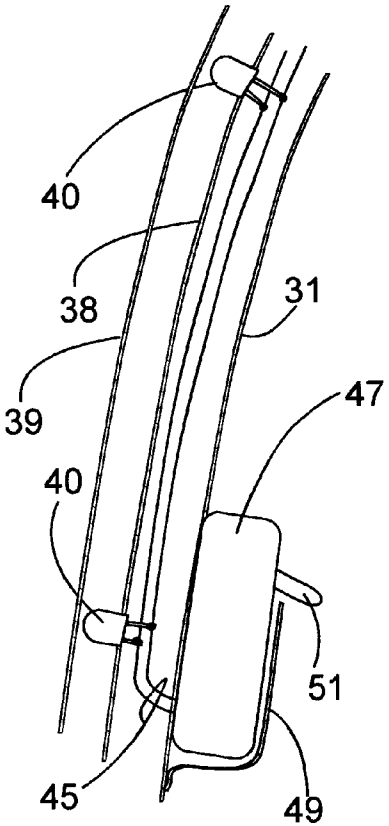
FIG. 4 is a cross-sectional view showing the manner in which the LID lamps are attached to the vest and interconnected with the battery supply.
Figure 3:
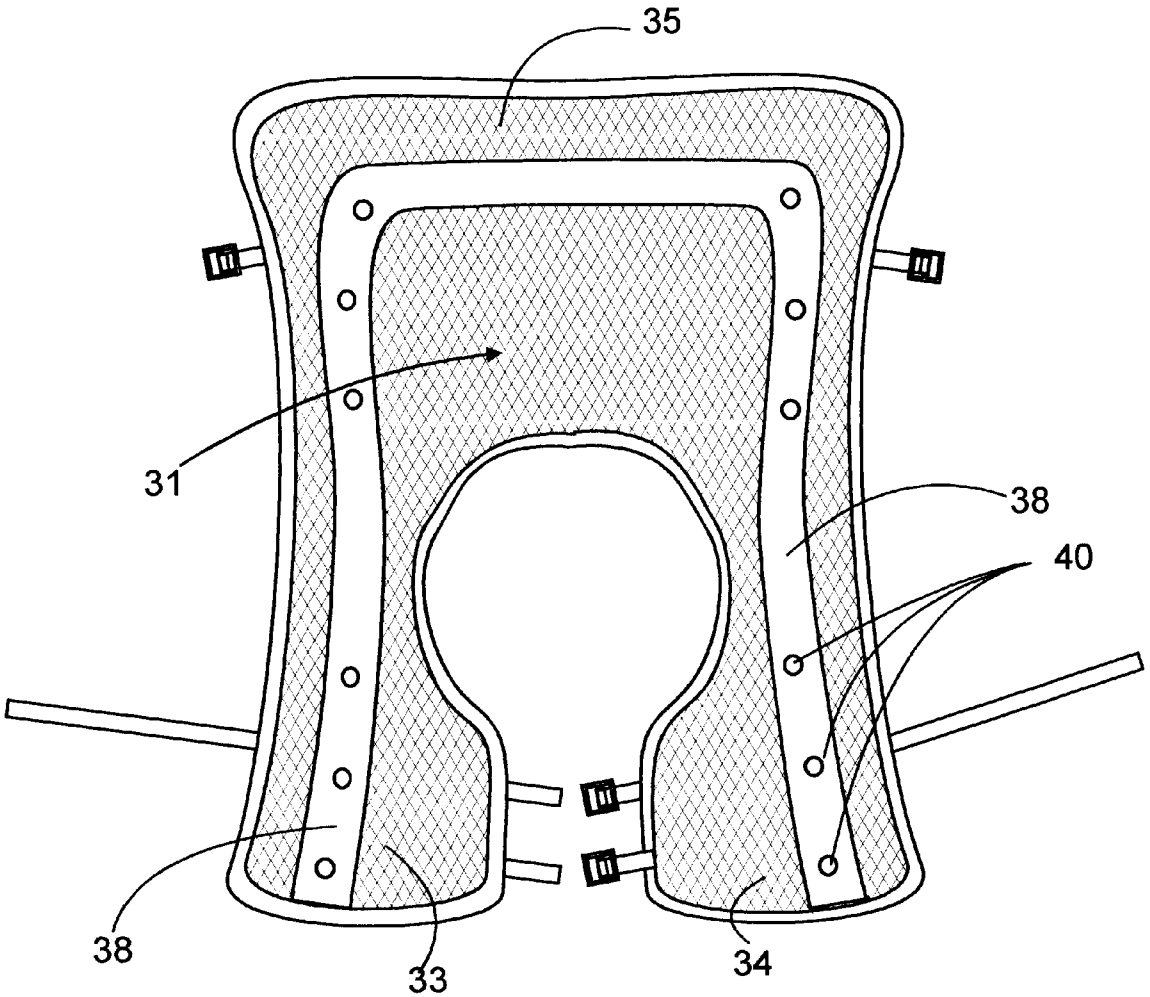
FIG. 3 is a plan view of a mesh safety vest of the type contemplated by the invention.

An alternative embodiment of the vest is shown laid flat in FIG. 3 and a portion of the vest is shown in cross-section in FIG. 4. The vest is shaped from a single sheet of stiff open mesh seen at 31 cut so that, when folded, it forms the front panels 33 and 34 and a back panel 35. A bead of reinforcing plastic sheet is folded over and sewn to the mesh shape at its edges to prevent fraying and to provide additional shape retentive rigidity to the vest. A strip of reflective material indicated at 38 is sewn onto the mesh at its edges, concealing and protecting the lamp conductors between the reflective strip 38 and the mesh 31. Fabric straps with conventional buckles fasten the vest in front and under the arms.

As seen in FIG. 4, each of the LED lamps 40 comprises a dome-shaped plastic lens section which houses the lamp and two electrical leads extending outwardly from the base of each lamp being connected to two power supply conductors 45 which supply power from the battery in the battery case seen at 47 which is supported within a pocket 49 sewn to inside of one front panel of the vest. The plastic lens section of each lamp is preferably sandwiched between an outer translucent plastic sheet 39 and the reflective backing 38 which are laminated together at the edges to form a ribbon sheath that encloses and protects the lamps. The outer plastic sheet 39 spreads the light from the point source lamps 40, making the light visible at a wider viewing angle and improving the visibility of the vest. The translucent plastic covering 38 may be tinted to provide colored light from a white LED source. A manual switch 51 extends from the battery case 47 and is easily accessible by the wearer to turn the lamps ON and OFF. A flasher circuit (not shown) may be mounted within the battery case 51 to provide intermittent switching to cause the connected lamps to flash.

It is to be understood that the embodiment of the invention which has been described above is merely illustrative of one application of the principles of the invention. Numerous modifications may be made to the methods and apparatus described without departing from the true spirit and scope of the invention.

What is claimed is:

1. A safety vest for protecting an individual during the performance of an activity made more hazardous when visibility is poor, said vest comprising, in combination, a light weight fabric forming front and back panels worn over the chest and back respectively of an individual, a continuous ribbon sheath attached to the outer surface of said fabric and extending over both said front and back panels, said ribbon sheath comprising:

an elongated, reflective backing sheet, a translucent cover sheet attached at the edges to the edges of said backing sheet, electrical power supply conductors sandwiched between said backing sheet and said translucent cover sheet and extending along the length of said ribbon sheath, and a plurality of spaced-apart electrical lamps each being connected to said conductors and positioned within said sheath sandwiched between said backing sheet and said translucent cover sheet such that light emitted directly by each of said lamps as well as light reflected from said reflective backing sheet shines through said translucent cover sheet, said lamps being positioned within said sheath such that, when said vest is worn on the body of said individual, at least one of said lamps is visible when viewed at a distance from said individual from any direction, a source of electrical energy attached to and carried by said vest, and electrical circuit means including a manually operated switch for connecting said battery to each of said lamps via said power supply conductors when said switch is closed.

2. A safety vest as set forth in claim 1 further comprising an automatically operating intermittent switch circuit for causing said lamps to flash ON and OFF.

3. A safety vest as set forth in claim 1 wherein said manually operated switch can be actuated to illuminate said lamps continuously, to cause said lamps to flash ON and OFF intermittently, or to terminate the illumination of said lamps.

4. A safety vest as set forth in claim 1 wherein at least a significant portion of light weigh fabric is an open mesh which allows cooling air to readily circulate therethrough.

5. The safety vest as set forth in claim 1 wherein said translucent covering effectively spreads the light from each lamp and increases the viewing angle from which said lamps may be seen.

6. The safety vest as set forth in claim 1 wherein said activity is hunting and wherein said ribbon sheath emits red light which is not readily visible to prey animals being hunted but which is readily visible to other hunters.

* * * * *

UNITED STATES PATENT AND TRADEMARK OFFICE

CERTIFICATE OF CORRECTION

PATENT NO. : 6,517,214 B1
DATED : February 11, 2003
INVENTOR(S) : Mitchell, Jr. et al.

It is certified that error appears in the above-identified patent and that said Letters Patent is hereby corrected as shown below:

Title page,
Item [12], delete "Mitchell,Jr. et al" and replace with -- Urbanus --; and
Item [76], delete "Kenneth C. Mitchell, Jr."

Signed and Sealed this

Twenty-fourth Day of June, 2003

JAMES E. ROGAN
*Director of the United States Patent and Trademark Office*